United States Patent [19]

Smith

[11] Patent Number: 4,929,088

[45] Date of Patent: May 29, 1990

[54] STATIC FLUID FLOW MIXING APPARATUS

[75] Inventor: Charles R. Smith, Bethlehem, Pa.

[73] Assignee: Vortab Corporation, Englwood Cliff, N.J.

[21] Appl. No.: 360,037

[22] Filed: Jun. 6, 1989

Related U.S. Application Data

[63] Continuation-in-part of Ser. No. 224,690, Jul. 27, 1988.

[51] Int. Cl.[5] ..... B01F 5/00

[52] U.S. Cl. ..... 366/337; 138/40; 138/42; 366/336

[58] Field of Search ..... 366/336, 337, 340, 341; 137/896; 138/38, 39, 40, 37, 42; 48/180.1, 189.4, 189.6

[56] References Cited

U.S. PATENT DOCUMENTS

| | | | |
|---|---|---|---|
| 3,051,453 | 8/1962 | Sluijters | 366/337 |
| 3,337,194 | 8/1967 | Zavasnik et al. . | |
| 3,620,506 | 11/1971 | So | 366/337 |
| 3,652,061 | 3/1972 | Chisholm . | |
| 3,733,057 | 5/1973 | Kahoun . | |
| 4,034,965 | 7/1977 | King . | |
| 4,072,296 | 2/1978 | Doom . | |
| 4,093,188 | 6/1978 | Horner . | |
| 4,112,520 | 9/1978 | Gilmore | 366/337 |
| 4,136,720 | 1/1979 | Kinney | 366/337 |
| 4,179,222 | 12/1979 | Strom et al. | 366/337 |
| 4,314,974 | 2/1982 | Libby . | |
| 4,352,378 | 10/1982 | Bergmann et al. | 138/38 |
| 4,363,552 | 12/1982 | Considine | 366/340 |
| 4,497,753 | 2/1985 | Streiff | 366/337 |
| 4,498,786 | 2/1985 | Ruscheweyh . | |
| 4,600,544 | 7/1986 | Mix . | |
| 4,747,697 | 5/1988 | Kojima | 138/42 |
| 4,808,007 | 2/1989 | King | 366/336 |

*Primary Examiner*—Timothy F. Simone
*Attorney, Agent, or Firm*—Darby & Darby

[57] ABSTRACT

A static mixing device adapted to be inserted in a fluid stream having a main flow direction with respect to a closed conduit, comprises at least two tabs inclined in the flow direction at a preselected elevation angle between 10° and 45° to the surface of the conduit. The tabs are spaced apart in a direction transverse to the flow direction, the length and width of the tabs being selected so as to generate pairs of oppositely rotating predominantly streamwise vortices at the tips of each tab, and downstream hairpin vortices interconnecting adjacent streamwise vortices generated by a single tab.

19 Claims, 4 Drawing Sheets

FIG. 10
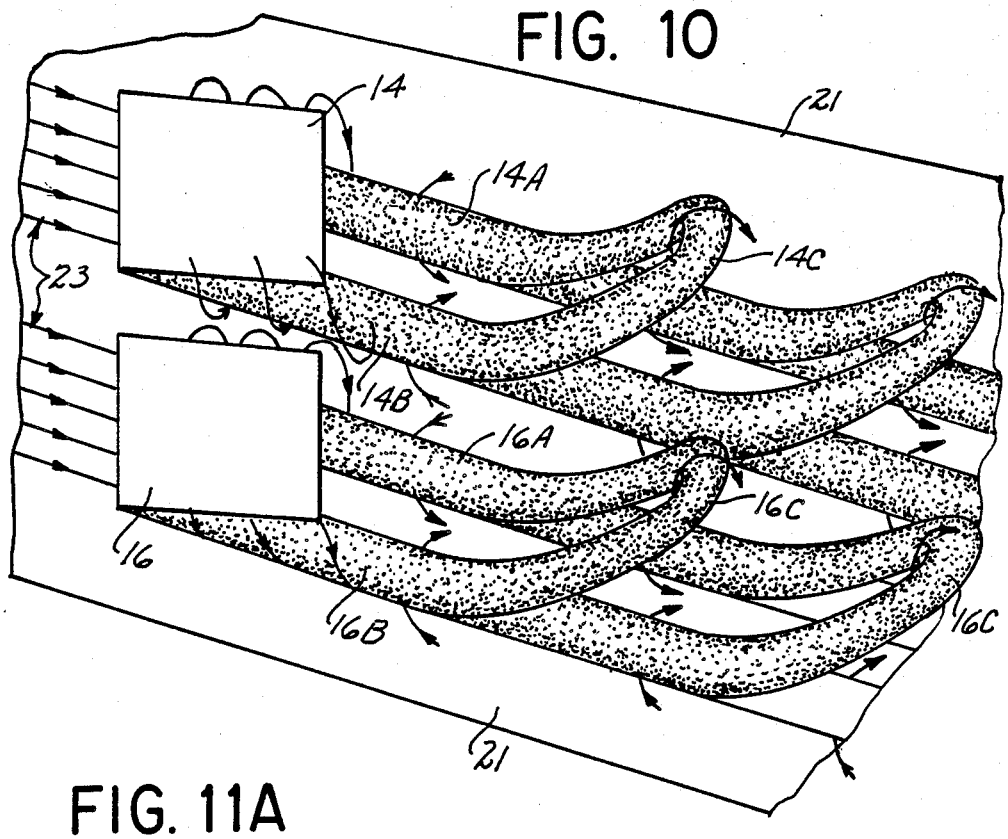
FIG. 11A
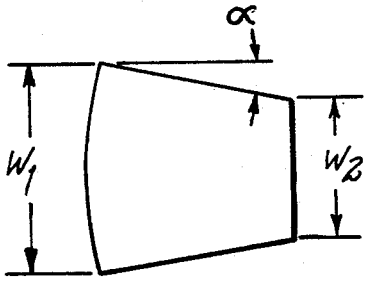
FIG. 11B
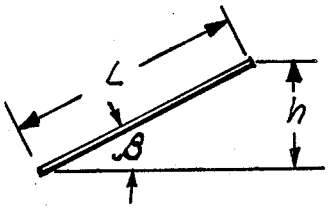
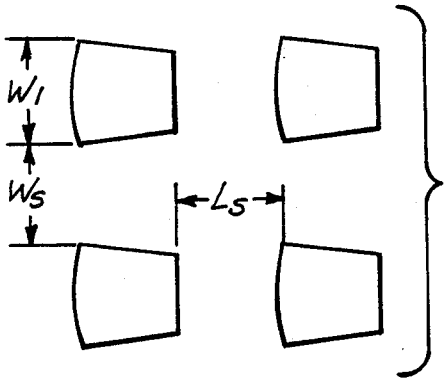
FIG. 11C

STATIC FLUID FLOW MIXING APPARATUS

This is a continuation-in-part of U.S. patent application Ser. No. 224,690 filed July 27, 1988 and entitled "Static Fluid Flow Mixing Apparatus".

BACKGROUND OF THE INVENTION

Static mixers or motionless mixing apparatus are widely employed to provide effective mixing and/or flow conditioning of one or more fluids flowing within a fluid containment and transport vessel, such as a circular pipe, and the like. The general technique employed by the previously known and used mixers and mixing apparatus was to divide the flow into a series of smaller, separate flow streams within the pipe or other vessel. These flow streams are then forcibly diverted away from neighboring flow streams and into proximity of more distantly removed flow streams Division into the series of separate flow streams is accomplished through the use of extensive series of baffles or spiraled inserts of rigid material inserted into the flow path. By inserting the baffles or spiraled inserts into the flow path, the flow streams are divided, and then divided again, until the entire flow is a plethora of intertwined flow streams. The intertwined separate flow streams will intermix due to the viscous characteristics and effects of the fluid.

The degree of effectiveness of these earlier static mixers and mixing apparatus varies with the particular design. The penalty one commonly pays with static mixers, however, is a significant increase in flow pressure and energy losses due to the excessive interference of the mixer or mixing apparatus with the main fluid flow. Additionally, since motionless mixers generally employ a large number of baffles or other convoluted pieces of rigid material placed in the path of the flow stream, this creates a number of surfaces upon which material suspended in the fluid may collect, causing the mixer to foul and plug during operation. The motionless mixers are generally effective in promoting fluid mixing, but do so at the significant expense of increased pressure and energy loss, and the increased necessity for frequent cleaning and/or replacement of the mixer.

Unlike prior static mixing approaches which are basically brute force techniques, the present invention relies on the implementation of more natural mixing processes which revolve about the controlled generation of vortices, or swirling motions in the flow. The natural character of a turbulent flow is to generate streamwise (flow direction) vortices in a somewhat organized fashion such that the swirling motions cause the movement of fluid perpendicular to the main flow direction. This is the physical process responsible for fluid flow mixing. When present in sufficient number and dispersed throughout the fluid flow, the effect of the streamwise vortices is to produce adequate cross-stream mixing (i.e. mixing due to the intermingling of fluid in directions perpendicular to the main flow direction).

It has been determined that the key to producing crossstream mixing, however, is that the vortices must be oriented in the main flow or streamwise direction to be effective. When the vortices are of such a streamwise orientation, they tend to push fluid away from the sides of a bounding surface (e.g. The wall of a pipe) and into the flow away from the surface (the outer flow). In such an orientation the vortices also pull fluid from the outer flow toward the bounding surface (e.g., the pipe walls). This alternating push-pull effect results in the cross-stream motion of alternating regions of inflow and outflow in proximity to a bounding surface creating a rich intermingling of the flowing fluid, and hence, mixing.

Clearly, the key point in the development of the static flow mixing apparatus of the present invention is the generation or artificial creation of flanking vortices oriented in the direction of the main flow with each vortex swirling in a direction opposing the direction of swirl of the adjacent vortices. The resulting flow pattern from these vortices is the creation of alternating "channels" across the flowing fluid within which the flow moves in opposing cross-stream directions.

In nature, these streamwise vortices do not remain in a stable configuration, due to the strong interaction between the adjacent, counter-rotating streamwise vortices. This interaction rapidly destabilizes the streamwise vortices such that a spanwise "connection" develops between the counter-rotating pair of streamwise vortices. These connections between the streamwise vortices rapidly create what appear as a continuous progression of arch-shaped vortices, commonly referred to as horseshoe or hairpin vortices. The development of these connecting arches does not alter the basic mixing effectiveness of the streamwise vortices, but appears to augment it by creating "subdivisions" in the movement of fluid pumped away from the surface, which facilitates an even more effective intermingling of the fluid regions being pushed away from the surface and pulled toward the surface by the action of the alternating streamwise portions of these vortices. As these arched vortices evolve, they undergo a complicated process of three-dimensional intertwining and agglomeration which facilitates the rapid dissipation of the original vortex pattern; the combination of the induced cross-stream mixing and the three-dimensional dissipation of the original vortex pattern promotes the rapid development of homogeneity of momentum and species concentration within the fluid.

Nature, left to its own devices, does an adequate job of creating similar conditions in a turbulent flow. The static flow mixer of the present invention assists this naturally occurring mixing by creating streamwise vortices in sufficient strength, spacing, and orientation such that the flow mixing process is substantially amplified and greatly accelerated.

Once the alternating streamwise vortex flow pattern is produced by the mixer, the natural interaction of the vortices with both the surrounding fluid and each other produces the desired mixing. Continued division and recombination of the flow (as is required in prior static mixing approaches) is not required.

The static mixing created by the present invention promotes the efficient circulation of fluid both towards and away from a bounding surface, which enhances not only fluid mixing, but also increases momentum and energy transport within the fluid as well as increasing the transfer of heat to or from the bounding surface by the flowing fluid. To understand the resulting effects of the fluid mixing one must recognize that a moving fluid has certain properties which are carried with it. Examples of these properties are the mass of the fluid, momentum (i.e. proportional to the velocity of the fluid), kinetic energy (proportional to the square of the velocity of the fluid), internal thermal energy (characterized by the temperature of the fluid), and species (any material mixed with the fluid. e.g. dissolved salts or dyes in water, water vapor or smoke in an airflow). Thus, when the fluid is caused to move perpendicularly to the main flow direction, the resulting cross-stream movement carries all of the above properties with the fluid. The interaction of this cross-stream flow with the surrounding fluid causes an exchange and intermingling of the fluid properties throughout the fluid. Thus, not only does the cross-stream motion set up by the mixer of the present invention cause the fluid to mix, but it also causes a mixing of the velocities (momentum), the kinetic energies, the fluid temperatures (i.e. thermal energies), and the transported species. The cross-stream mixing causes the resulting mixed fluid to take on the "average" of the properties of the mixed fluid streams. For example, if a high temperature fluid enters and mixes with a region of lower temperature fluid, the resultant temperature of the mixed fluid will fall somewhere between the high and low temperatures. If the process of cross-stream fluid movement is greatly accelerated, such as is accomplished with the mixing apparatus of the present invention, the fluid properties in the main flow will become more homogeneous and uniform more quickly. The complete mixing of a fluid flow would result in the complete identity of any point within the flow with any other for each of the flow properties described above, i.e. mass flow, velocity, temperature, and species.

In addition to the mixing of fluid properties across a flow, the cross-stream movement of fluid in proximity to a solid boundary, e.g. a pipe wall, will result in the increased transfer of heat from the boundary material to the fluid, or from the fluid to the boundary material. The amount of heat which will be transferred to or from a surface, such as the cooled or heated wall of a pipe, depends directly upon the difference in temperature between the wall of the pipe and the fluid directly adjacent thereto.

Normally, for a laminar flow, the fluid near the boundary surface is very close to the temperature of the boundary material, resulting in low heat transfer. If the flow is more turbulent, there is a cross-stream flow pattern set up which brings fluid from the center of the vessel or pipe toward the boundary surface and carries fluid away from the boundary surface toward the center of the vessel. This interaction results in a greater temperature difference, on the average, between the boundary surface and the fluid adjacent to that surface. Thus, a greater thermal energy exchange will occur. The same process applies for the transfer of species to and from the boundary surface and the center of the vessel, and vice versa.

Thus, the static mixing apparatus of the present invention can be used effectively to mix a flowing fluid to yield substantially uniform velocity, energy, and species concentration and to significantly increase the amount of thermal energy transferred between the fluid and the boundary surface material. This increase in uniformity of the various properties of the fluid demonstrates the equalization of the distribution of each of these properties throughout the fluid by the static mixing apparatus.

It is therefore an object of the present invention to provide a static mixing apparatus, of the motionless type, which will substantially increase the various properties of the fluid to a uniform distribution and/or concentration.

It is a further object of the present invention to provide a static mixing apparatus which is self-cleaning and non-plugging present invention It is still a further object of the present invention to provide an accelerated cross-stream mixing of the fluid in a significantly reduced streamwise distance.

It is another object of the present invention to provide a greater thermal exchange between the fluid and the boundary material by creating alternating flows of fluid both toward and away from the boundary surface and the center of the containment and transport vessel due to the action of vortices swirling in a streamwise direction.

It is still another object of the present invention to provide greater cross-stream mixing of a fluid in the streamwise direction to achieve more uniform flow properties in fluid.

Other objects will appear hereinafter.

SUMMARY OF THE INVENTION

The present invention is a relatively simple The primary element of the invention is one or more ramped tabs which project inward at an acute angle from a bounding surface such that the tabs are sloped or inclined in the direction of the fluid flow. The tabs may be square or rectangular in shape, or tapered inward from the base, which adjoins the bounding surface, toward the tip of the tab. The tabs may also be semi-ellipsoid in shape. The ramped tabs are spaced apart such that they form a row across, or about the circumference of, the bounding surface transverse to the main flow direction. When configured in rows, the main flow must pass over and between the spaced apart tabs. As the fluid flows across each tab it is deflected inwardly towards the center of the containment and transport vessel causing the pressure to increase on top of the tab as the flow alters direction. Because the fluid pressure underneath the tab is lower than the fluid pressure on top of the tab, the fluid will flow toward the lower pressure along the distal underside of the tab. This creates a flow around the sides and outer tips of the tabs forming tip vortices having their axes of rotation along the direction of the main flow.

Each tab generates a pair of flanking tip vortices, each of opposite rotation. By locating a series of tabs spaced either uniformly or non-uniformly circumferentially about the boundary surface, an organized set of paired tip vortices having alternating directions of rotation will be generated by each tab. Multiple rows of tabs, either in line with the same tab in the successive row or staggered between tabs in the successive row, may be placed at successive streamwise locations along the boundary surface to achieve the desired mixing effect.

The present invention also includes a method for producing cross-stream mixing in a fluid flow comprising the placing of one or more tabs, or arrays of tabs, wherein the individual tabs and the tabs of said arrays are inclined inward at an acute angle from a bounding surface of a fluid containment and transport vessel, in the main flow causing the fluid to flow over the opposite edges of each tab, or the tabs in said arrays, by deflecting the flowing fluid inward and up the inclined surface of each tab, or each tab of said arrays, to generate tip vortices in the flow having their axes of rotation in the streamwise direction of the flow. The method further comprises the generating of a pair of tip vortices, each said vortex having an opposite rotation to its paired vortex.

BRIEF DESCRIPTION OF THE DRAWINGS

For the purpose of illustrating the invention, there is shown in the drawings forms of the invention which are presently preferred: it being understood, however, that the invention is not limited to the precise arrangement and instrumentalities shown.

FIG. 10 is a schematic illustration showing an idealized generation of oppositely rotating, streamwise and hairpin vortices by a pair of tab mixers in accordance with the invention.

FIGS. 11A–11C show the construction of a representative tab and tab array in accordance with the invention for the purpose of explaining various dimensional relationships.

DETAILED DESCRIPTION OF THE INVENTION

The following detailed description is of the best presently contemplated modes of carrying out the present invention. This description is not intended in a limiting sense, but is made solely for the purpose of illustrating the general principles of the invention.

Figure 1:
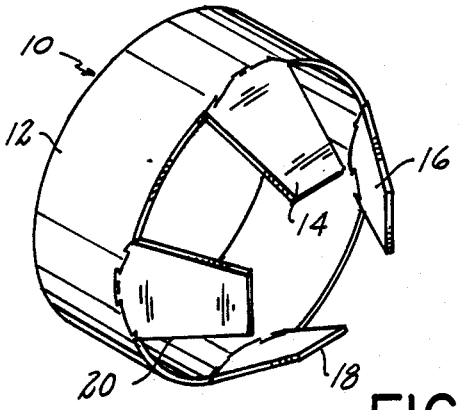
FIG. 1 is an isometric view of an embodiment of the flow tab array of the present invention.

Referring now to the drawings in detail, wherein like numerals represent like elements, there is shown in FIG. 1 one embodiment of a tab array 10 of the present invention. In this embodiment the tab array 10 is maintained in its uniformly spaced apart relationship by a collar 12 which is constructed to fit inside and immediately adjacent to the interior wall of a fluid containment and transport vessel, e.g. a pipe. Each of the tabs or protrusions into the mainstream flow are arranged about the periphery of the collar 12 and are attached thereto. The tabs 14, 16, 18, and 20 are oriented to extend downstream of the collar 12 when inserted into a fluid transporting vessel. The tabs 14, 16, 18, and 20 also extend inwardly from their respective bases at an acute angle ranging between 10° to 45° as measured from the interior circumferential wall of the containment and transport vessel. The angle of incline is preferred to be in the range of 20° to 35° for better operability and resulting mixing. The number of tabs may vary depending upon the size of the containment and transport vessel, the viscous nature of the fluid, the amount and density of species carried by the fluid, the depth of the fluid, etc. It is believed that uniform spacing of odd or even numbers of tabs is necessary to obtain the desired results with the use of the present invention in a filled or substantially filled containment and transport vessel. However, to achieve specific mixing characteristics, non-uniform spacing may be desired.

Figure 3:
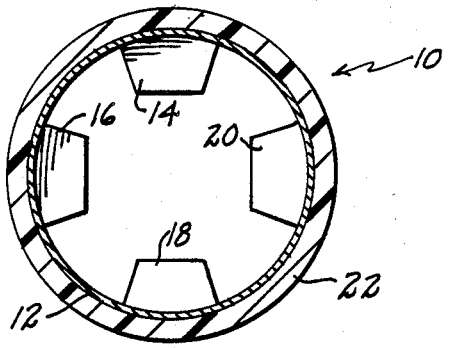
FIG. 3 is a sectional view of the flow tab array taken along the line 3—3 of FIG. 2.
Figure 2:
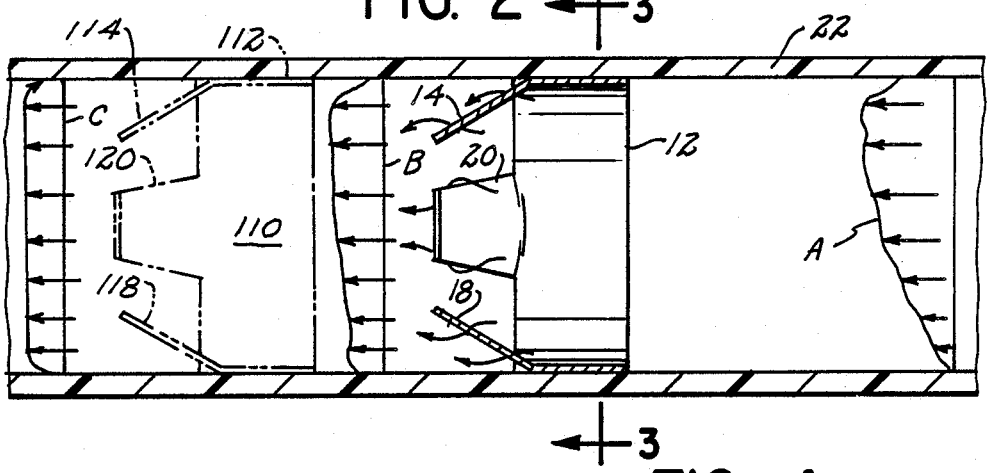
FIG. 2 is a sectional view of a bounding vessel having a fluid flowing through the flow tab array(s) of FIG. 1.

The tab array 10 can be inserted into a fluid containment and transport vessel such as the pipe 22 in FIGS. 2 and 3. The collar 12 of the tab array 10 may be affixed to the interior surface of the pipe 22 by any presently known adhesive, which does not react with the fluid, or by pressure fit of the expansion of the collar 12 against the interior of the pipe surface. The adhesion of the pressure fit holds the tab array 10 in a perpendicular position to the direction of the fluid flow. The fluid in the pipe 22 of FIG. 2 fills the pipe and is flowing from right to left. At the right side of the section of the pipe 22 the turbulent flow is depicted by velocity profile A. Velocity profile A indicates that the flow is of a non-uniform rate as measured at a preselected point along the length of the section of pipe 22; the flow at the top of the pipe 22 being greater then the flow at the bottom of the pipe 22. Although, the example of a flow used to describe the embodiments of the invention is a turbulent flow, the invention performs just as well in laminar and transitional flows.

Interposed into the non-uniform turbulent flow is the tab array 10 of the present invention. As the fluid reaches the tabs 14, 16, 18, 20, spaced and constructed so as to be placed in the main path of the flow, the fluid is forced to flow between and around each of the tabs as follows. The fluid is deflected up along the proximal surface of a tab creating an increase in pressure along said face and a decrease in pressure along the distal face. of the tab. The fluid, as depicted by the flow direction arrows or streamlines in FIG. 2, flows outward, in relation to the tab, around the sides and outer tips of the tab. This is a result of the fluid flowing from the area of increased pressure on the proximal face of the tab to the area of decreased pressure on the distal face of the tab. The flow around the tabs 14, 16, 18, 20 causes the formation of tip vortices.

A pair of oppositely rotating, flanking tip vortices are generated by each tab 14, 16, 18, 20. These tip vortices rotate about their axes of rotation oriented in the direction of the main fluid flow. As viewed from downstream, the tip vortex on the right of a tab will be of clockwise rotation and the tip vortex on the left of the tab will be of counter-clockwise rotation. By placing an organized set of ramped tabs in the path of the main fluid flow, an organized set of tip vortices having alternating directions of rotation will be generated. The alternating rotations of the tip vortices will induce vigorous cross-stream mixing of the fluid.

FIG. 10 shows two tabs 14 and 16 secured in any suitable fashion to a flat bounding surface 21. The main fluid flow is shown by the arrows 23. As the fluid, which may be a liquid or a gas passes over the tabs 14 and 16, vortices 14A and 14B are formed by tab 14, and vortices 16A and 16B are formed by tab 16. Each pair of vortices 14A, 14B or 16A, 16B constitutes a pair of oppositely rotating, flanking vortices with the axes of rotation extending generally in the flow direction as represented by the arrows 23. The sense of rotation of the vortices in FIG. 10 is represented by the adjacent arrows (unnumbered).

As indicated above, these streamwise vortices 14A, 14B and 16A, 16B do not remain in a stable configuration due to the strong interaction between the adjacent counter-rotating streamwise vortices. This interaction rapidly destabilizes the streamwise vortices 14A, 14B and 16A, 16B such that a spanwise "connection" develops between the counter rotating streamwise vortices 14A, 14B or 16A, 16B. These connections between the streamwise vortices rapidly create what appear as a continuous progression of arch-shaped vortices 14C and 16C, respectively. Such arch-shaped vortices are commonly referred to as horseshoe or hairpin vortices and are referred to hereinafter as hairpin vortices.

As heretofore described. When an organized set of ramped tabs. e.g., the tab array 10, is employed, the vortices generated by the tabs dramatically increase the cross-stream movement of the fluid. This increase in cross-stream movement also increases the uniformity, or homogeneity, of the fluid velocity distribution. By comparing the unmodified fluid velocity (velocity profile A) with the fluid velocity after having passed through a single tab array (velocity profile B), it can be readily seen that the tab array 10 creates a much more uniform fluid velocity as the fluid flows through the containment and transport vessel. Adding an additional tab array 110 (shown in phantom), with tabs 114, 116, 118, 120, an even greater uniformity in fluid velocity can be achieved. Velocity profile C indicates that an unmodified turbulent fluid, having passed through two tab arrays 10, 110 of the present invention was subjected to such increased and vigorous cross-stream mixing of the fluid that the velocity of the entire fluid at the point of measurement of velocity profile C has been rendered virtually uniform.

In addition to affecting the uniformity of the fluid velocity across the containment and transport vessel, the tab array of the present invention also promotes the transfer or exchange of thermal energy within the fluid and between the fluid and a bounding surface, for example, the containment and transport vessel. The organized set of ramped tabs creates a cross-stream intermingling of the fluid which causes the rapid and continued movement of said fluid from the center of the vessel to the areas adjacent the walls of the vessel and back to the center. Thus, a rapid exchange of thermal energy can be achieved by use of the organized ramped tab array to equalize the temperature of the fluid and/or to heat or cool the fluid more quickly as it passes through a temperature controlled section of the containment and transport vessel.

Use of the present invention and the oppositely rotating, flanking vortices which are created thereby dramatically increases the cross-stream movement of fluid such that the temperature difference between the boundary surface and the fluid adjacent thereto will be significantly increased. Hence, the transfer of thermal energy to or from the fluid will be proportionately increased. The rapid and continued movement of fluid to and from the bounding surface and the center of the vessel assures the greatest instantaneous temperature difference between the fluid and the boundary surface. Therefore, the exchange of thermal energy will remain at a higher level than for naturally occurring processes and will continue at that level until an equilibrium condition is reached.

This same process can be used and/or applied to the mixing or transfer of species to or away from a bounding surface, for example of a containment and transport vessel. Again, the rapid and continued movement of fluid to and from the bounding surface and the center of the vessel assures the greatest instantaneous concentration difference between the fluid at the center of the vessel and the fluid at the boundary surface. Therefore, the mixing of species will remain at a higher level than for naturally occurring processes and will continue at that level until an equilibrium condition is reached. An example of this type of exchange process would be the drying of a surface by airflow over the surface.

Experiments performed with the tab array 10 of the present invention have indicated that the unique orientation and spacing of the tabs 14, 16, 18, 20 results in dramatically lower pressure losses than other static mixers and flow conditioners. For example, the "two row" tab array (tab arrays 10, 110 of FIG. 2 which generated the flat velocity profile C) caused a pressure loss which was 60% less than the minimum pressure loss generated by the best previously known flow conditioners which can achieve a similar velocity profile improvement. This is indicative of a 60% savings in pumping energy and power by the tab array of the present invention over the best presently available static mixer which accomplishes the same degree of mixing. In addition, since the ramped tabs 14, 16, 18, 20 of the tab array 10 slope away from the main streamwise flow direction, the tabs are self-cleaning and non-plugging. Also, the tip vortices generated by the tabs 14, 16, 18, 20 assist in the self-cleaning process by keeping the undersurface of each tab scoured by their strong rotation The term "scouring" is used to convey the understanding that the tip vortices are always rotating fluid around and under the sloping distal face of the tabs 14, 16, 18, 20 which keeps solid particulate materials that might be in the flow from collecting under the tab or between the tab and the interior surface of the containment and transport vessel.

Figure 4:
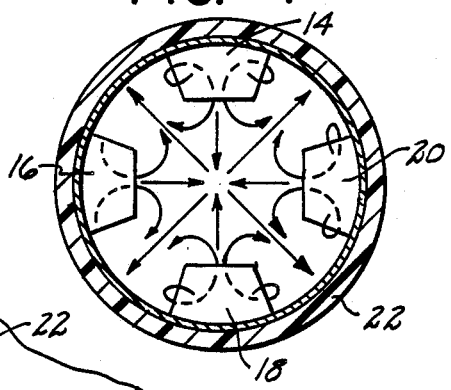
FIG. 4 is the same sectional view of the flow tab array of FIG. 3 looking downstream with flow direction arrows.

Referring now to FIGS. 3 and 4, the tab array 10 of the present invention is shown looking downstream. The tabs 14, 16, 18, 20 are arranged about the periphery of the tab array 10 at equally or uniformly spaced locations. In the case of the present example, four (4) tabs are used which are located about the collar 12 of the tab array 10 with their centers spaced 90. apart. This organized series of tabs 14, 16, 18, 20 are each located on the collar 12 along the same circumferential line about the collar. As previously described, the tabs 14, 16, 18, 20 are inwardly directed at an acute angle preferred to range between 20° and 35° measured from the bounding surface, although the overall angular range may be between 10° and 45°. The tabs 14, 16, 18, 20 are inclined in the direction of the main streamwise flow. The tabs 14, 16, 18, 20 may be of a square or rectangular shape or may be tapered as they project upward and inward from the base of the tab connected to the supporting member, the collar 12. The tabs 14, 16, 18, 20 may also be semi-ellipsoid in shape. The physical size of the tab will vary in direct proportion to both (1) the shape and size of the containment and transport vessel, and (2) the number of tabs placed about the internal periphery of said vessel.

Although the shape of the tabs may vary from square to rectangular or approach the shape of a trapezoid, the lengthwise dimension of the tab, in the direction of the main streamwise flow, is preferred not to exceed twice the width of the tab. As can be observed from the drawings, the presently preferred shape of a tab is that of a trapezoid having its bases substantially approach the measurement of its altitude such that the parallelogram is almost square in shape. For this particular embodiment the approximate dimensions are: the internal diameter of the pipe 22 is three (3 inches, the tab length is one (1) inch, and the base width of the tab is one (1) inch tapering at the top to ⅝ of an inch.

FIG. 4 shows the flow direction of the tip vortices as they are generated by the tabs 14, 16, 18, 20. Looking downstream, the fluid is deflected up the incline of the proximal face of the tabs (i.e. The surface of the tab facing toward the main flow). Due to the pressure differential created by the inclined tab, the fluid flows around either side and outer tips of the tab resulting in the generation of tip vortices. Simultaneously, the fluid strikes each of the tabs 14, 16, 18, 20, is deflected up the incline of the proximal faces of the tabs, and flows around the opposite sides of the tabs generating alternating tip vortices shown by the curved flow direction arrows in FIG. 4. Additional flow direction arrows show the effect of the alternating rotations of the tip vortices which create cross-stream flows alternately inward toward the center of the containment and transport vessel, the pipe 22, and outward toward the boundary surface of the pipe. Although not shown in FIGS. 4 and 5, hairpin vortices as shown in FIG. 10, are also generated when the invention is employed in a conduit such as pipe 22. It is the combination of the streamwise, oppositely rotating vortices and the arcing hairpin vortices that is responsible for the improvement in uniformity of the streamwise velocity profile and equalization of properties in the fluid and in the flow.

Figure 5:
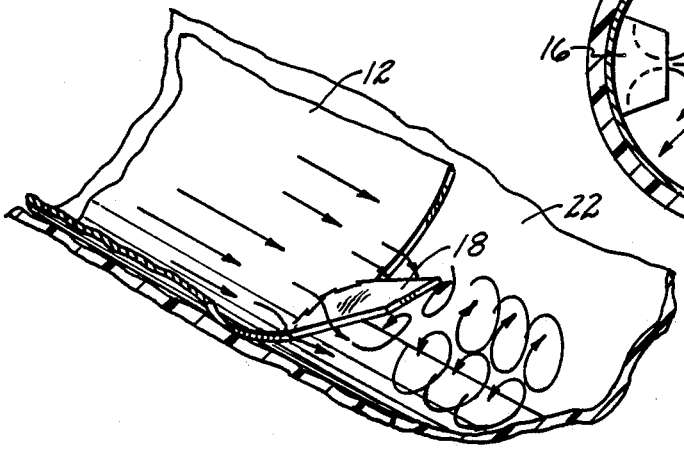
FIG. 5 is a sectional view of a bounding vessel having a curvilinear interior surface adjacent to which a single tab of the tab array of the present invention is shown with flow direction arrows indicating the generated vortices.

Referring now to FIG. 5, the generated tip vortices can be seen with greater clarity. Taking a single tab, tab 18, which is oriented along the bottom of the containment and transport vessel, the pipe 22, the particular direction of fluid flow can be seen without confusing any particular flow direction arrow or streamline with neighboring streamlines. The main streamwise flow is shown by the flow direction arrows located along the inside of the collar 12. As the flow strikes the base of the tab 18 it is deflected up the angled incline creating a pressure differential between the proximal face of the tab (the face of the tab facing toward the main flow) and the distal face of the tab (the face of the tab facing away from the main flow). The fluid flows up the proximal face of the inclined tab 18 and over the opposite edges and tips thereof. Once over the edges, the fluid flows underneath the tab 18 and across the distal face until it meets the opposing fluid flowing from the opposite edge of the tab at approximately the center of the tab 18. Each of the flows reverses its direction as it meets the opposing flow. While this is occurring, the fluid still retains a streamwise flow direction which creates the tip vortices by repeated meetings of the flows from either edge of the tab 18. Hence, the alternating rotations of the tip vortices are generated and the cross-stream mixing occurs along the streamwise direction of the main flow.

This flow reversal requires a minimum distance to complete the rotation, or axial revolution, begun as the fluid flows over the opposite edges of the tab. For this reason a tab shape, such as a triangle, is not desired because complete revolution would not be attainable near the forward apex of the triangle. The complete axial revolution promotes the equalization of the various properties of the fluid and the flow in a much shorter distance than experienced with prior static mixing or flow conditioning devices, or with natural mixing.

Figure 7:
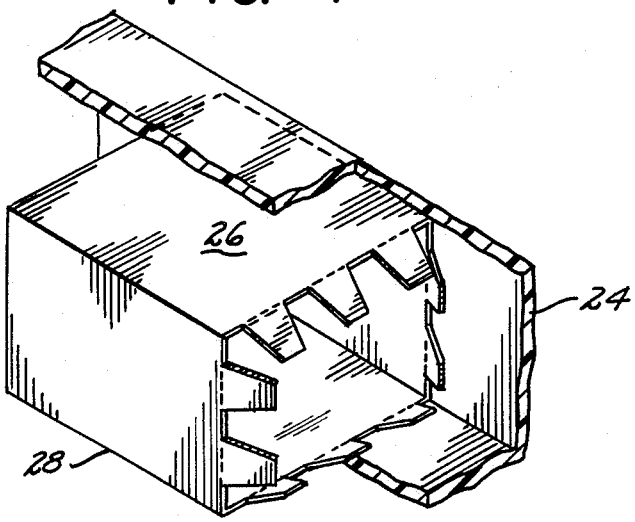
FIG. 7 is a partially cutaway perspective view of an alternate embodiment of the tab array of the present invention inserted in a rectangular cross-sectional boundary vessel

An alternate embodiment of the present invention designed to accommodate a rectangular containment and transport vessel, a duct 24, rather than a round pipe 22, is shown in FIG. 7. Rectangular ducts 24 are normally used to contain and transport fluids in their gaseous states, but can be used for fluids in their liquid states. A tab array 26 configured with a rectangularly shaped collar 28 to fit within the duct 24 will promote cross-stream mixing of a gas, i.e. heated or cooled air, using identically configured and arranged tabs. The tabs are uniformly spaced along the periphery of the downstream end of the collar 28 and inclined in the direction of the flow at an acute angle within the range between 10° and 45°. Similar to the case of the tab array 10 placed within a circular bounding surface, the tab array 26 placed within a rectangular bounding surface will generate alternating rotation streamwise vortices and hairpin vortices which promote vigorous cross-stream mixing and equalization of the properties of the fluid and the flow over a much shorter distance than experienced with prior static mixing or flow conditioning devices, or with natural mixing. The present invention may also be used in an open conduit or containment and transport vessel, creating cross-stream mixing within the fluid.

Figure 8:
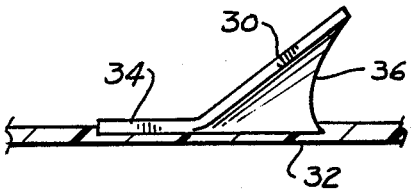
FIG. 8 is a side view of a single tab of the present invention attached to the interior surface of a boundary vessel.
Figure 9:
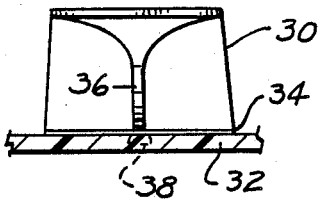
FIG. 9 is a downstream view of a single tab of the present invention attached to the interior surface of a boundary vessel.

Rather than require a collar for all embodiments of the static mixer of the present invention, individual tabs can be arranged about the bounding surface. Referring to FIGS. 8 and 9, a tab 30 is shown inclined inward from a bounding surface 32 at an acute angle in the preferred range between 10° and 45°. The tab 30 is supported by a base member 34 and maintained at the desired predetermined angular relationship to the bounding surface 32 by a support member 36. The lower edge of the support member 36 has a flange 38 which may also extend along the underside of the base member 34 for securing the tab 30 to the bounding surface 32. A slot in the bounding surface 32 is configured to receive the flange 38 such that the flange 38 is oriented parallel to the main streamwise flow direction of the fluid. The proximal face of the tab 30, the surface of the tab facing toward the flow, is oriented in a transverse or perpendicular direction to said flow. The flange 38 may be secured within the slot by pressure fit and/or with the assistance of an adhesive which will not react with the fluid. Additionally, the flange 38 may be omitted from the basic structure and the base member 34 and the support member 36 welded or adhesively affixed directly to the interior surface of a containment and transport vessel.

Several tabs, such as tab 30, can be placed in slots provided for them at locations spaced about the interior of the bounding surface 32. Each of the slots will be required to be oriented in parallel relation to the others. A series of slots may be placed about the interior of a bounding surface to accommodate different numbers of tabs at uniform, or nonuniform, spacings. Thus, several configurations of tab arrays may be created in a single bounding surface by the manipulation of the tabs from location to location, e.g. three, four, six, or eight tabs may be attached without having to replace a section of the containment and transport vessel or purchase a specially configured tab array. For example, the tab array may comprise two or more tabs located along the bounding surface below the fluid flow level in an unfilled or open conduit to promote cross-stream mixing. Another configuration may comprise six uniformly spaced apart tabs located along the bounding surface in a filled conduit. Either spacing or arrangement will promote cross-stream mixing equally well.

Figure 6:
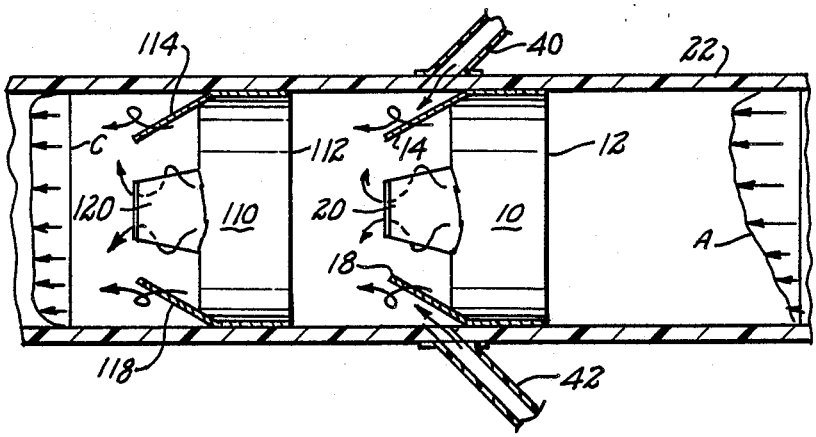
FIG. 6 is a sectional view of a bounding vessel having a fluid flow flowing through two flow tab arrays of FIG. 1 with additional fluid injected into the flow intermediate between each of the tab arrays from opposing sides of the boundary vessel.

Referring now to FIG. 6, there is shown a fluid containment and transport vessel 22 having two tab arrays 10, 110 placed sequentially within the bounding surface. Each of the tab arrays 10, 110 are oriented such that their respective tabs are positioned in line with each other in a streamwise direction. The orienting of successive rows of tabs in a staggered arrangement is contemplated by the present invention and may be used for creating a more vigorous cross-stream mixing to more quickly eliminate flow anomalies in the mainstream flow.

The tab arrays 10, 110 each generate alternating rotation tip vortices as the fluid flows between and around their respective tabs, as shown by the flow direction arrows or streamlines. A non-uniform velocity profile A exists for the unmodified fluid flow at the upstream end of the segment of the pipe 22. Immediately downstream and beneath two of the tabs 14, 18 of the tab array 10, each of two nozzles 40, 42 introduce a second fluid into the pipe 22 for mixing with the first fluid. (The nozzles 40, 42 could each introduce another fluid or a particulate solid but, for the purpose of this example the identical fluid will be introduced by both nozzles.) The second fluid flows into the pipe 22 at points beneath the tabs 14, 18 and is immediately caught up in the vortices generated by each tab. The second fluid is, thus, immediately subjected to the same cross-stream mixing as is the primary fluid. The partially mixed fluids then pass through the second tab array 110, pass around the tabs 114, 116, 118, 120 and through the tip vortices generated by the tabs. This creates a more complete cross-stream intermingling of both the primary fluid and the second fluid than with a single tab array. The velocity profile C at the downstream end of the segment of the pipe 22 indicates an almost complete uniformity of velocity across the pipe. The introduction of a second fluid at another location between the two tab arrays 10, 110 may not result in the mixing of the two fluids as quickly, although some fluid mixing will be evident from the passage of the fluids through the tab array 110. The introduction of the second fluid beneath the tabs 14, 18 does, however, take maximum advantage of the cross-stream flow generated by the tip vortices from those tabs.

Using multiple rows of tab arrays will further increase the intermingling and cross-stream mixing of the main flow. In line or staggered rows will work equally effectively. Further, increasing the number of rows of tab arrays will increase the amount of mixing accomplished by the tabs.

The static mixer tab arrays disclosed herein are particularly useful for, but not limited to, the development of uniform flow velocity distributions immediately upstream of the measurement of the flow with a flow meter, the uniform mixing of two different species in a flowing fluid, the increased transfer of thermal energy to and/or from a flowing fluid at the bounding surface, and the improved drying of surfaces using flowing fluids, among others. The static mixer tab array design is particularly simple to construct and characterized by its low cost of operation and maintenance. Because the static mixer of the present invention is configured to promote a "natural" mixing pattern, the redirection of momentum and kinetic energy in the flow results in a maximized intermingling of the fluid and a minimized loss of pumping energy. The end result achieved is a minimum pressure loss and significant energy savings relative to existing static mixers.

As mentioned above, the principles of the invention are useful in mixing gases and liquids; moreover, the principles of the invention can be used with a closed bounding surface (e.g., a pipe) or a bounding surface which is not closed (e.g., a flat surface in which the flow of air is used to effect drying). An example of such an application is in convective drying ovens where fruits and other food products are dried by heated air passing over holding trays.

Experiments have established effective and optimal ranges of the various dimensional parameters of the invention. These ranges are set forth below with reference to FIGS. 11A, 11B and 11C with the dimensions being shown in these drawings. FIGS. 11A and 11B are top and side views, respectively, of a single tab, generally in the shape of a trapezoid, intended for use in a circular pipe. FIG. 11C is a top view of an array showing two rows of tab arrays spaced by the distance $L_S$. Two tabs in each array are illustrated. Experiments have indicated that the dimensions are not critical in that some benefit can be achieved even when operating outside of the stated effective range. For example, the elevation angle ($\beta$) can be greater than 45° but it has been discovered that when the elevation angle exceeds 45° there is a substantial price to pay in terms of the increased pressure drop caused by the presence of the tab in the fluid flow. The values given in the following table are based on experimental data except for the values which appear in parentheses. Those ranges appearing in parentheses are not based on experiments but are instead theoretical. The values given apply to any surface with the exception of tab height (h) which is indicated as a fraction of the pipe diameter in the case of a circular conduit. For other surfaces, the height is a function of length L and elevation angle

| PARAMETER | EFFECTIVE RANGE | OPTIMAL VALUE OR RANGE |
|---|---|---|
| Ratio of Length, L, to Width, $W_1$. | $0.5 \leqq L/W_1 \leqq 3$ | $1 \leqq L/W_1 \leqq 2$ |
| Width at base, $W_1$. | Will depend on the number of tabs and spacing (see below) | |
| Taper angle, $\phi$ | $-10° \leqq \phi \leqq 30°$ | $0° \leqq \phi \leqq 20°$ |
| Width ratio, $W_2/W_1$ | $0.3 \leqq W_2/W_1 \leqq 1.2$ | $0.6 \leqq W/_2/W_1 \leqq 1.1$ |
| Tab end shape | (Probably square or slightly rounded corners) | |
| Elevation angle, $\beta$ | $10° \leqq \beta \leqq 45°$ | $20° \leqq \beta \leqq 35°$ |
| Tab height, h | $0.1 \leqq h/D \leqq 9,3$ | $(0.16 \leqq h/D \leqq 0.24)$ |
| Spacing between tabs of an array: Width ratio, $W_s/W_1$ | $0.5 \leqq W_s/W_1 \leqq 2$ | $W_s/W1 = 1$ |
| Spacing between tab arrays: Length ratio, $L_s/W_1$ | $(0.5 \leqq L_s/W_1 \leqq 6)$ | $(1 \leqq L_s/W_1 \leqq 2)$ |
| Method of arrangement of multiple arrays (row) of tabs | in-line or staggered | in-line |

The number of tabs in a single array (row) of tabs in a circular pipe may depend on the tab geometry and it is contemplated that anywhere from two to ten tabs can be used in a single row with four tabs being optimal at least for a geometrically symmetric tab in which the length L is equal to the width $W_1$.

Tests have been conducted for Reynolds numbers as low as 1000. These tests have not indicated any significant change in the optical geometric ranges given above as a function of the Reynolds numbers.

The present invention may be embodied in other specific forms without departing from the spirit or essential attributes thereof and, accordingly, reference should be made to the appended claims, rather than to the foregoing specification, as indicating the scope of the invention.

What is claimed is:

1. A static mixing device adapted to be inserted in a fluid stream having a main flow direction with respect to at least one bounding surface, comprising:

at least two tabs projecting from said at least one bounding surface and inclined in the flow direction at a preselected elevation to said bounding surface, said tabs being spaced apart in a direction transverse to said flow direction, the length (L), width (W) and elevation angle being selected so as to generate pairs of oppositely rotating, predominantly streamwise vortices at the tips of each tab.

2. A static mixing device according to claim 1, wherein the elevation angle and dimensions of said tabs are selected so as to result in the generation of downstream hairpin vortices interconnecting adjacent streamwise vortices produced by each individual tab.

3. A static mixing device according to claim 1, wherein said elevation angle is between 10° and 45°.

4. A static mixing device according to claim 3, wherein said elevation angle is between 20° and 35°.

5. A static mixing device according to claim 3, wherein:

$$0.5 \leqq L/W \leqq 3$$

6. A static mixing device according to claim 3, wherein:

$$1 \leqq L/W \leqq 2$$

7. A static mixing device according to claim 3, wherein said tabs are spaced apart a distance $W_s$ and wherein $$0.5 \leqq Ws/W \leqq 2$$

8. A static mixing device according to claim 5, wherein said tabs are in the shape of a trapezoid with the width of each said tab at the end in contact with the bounding surface being $W_1$ and the width of said tab at the other end being $W_2$, and wherein:

$$0.3 \leqq W_2/W_1 \leqq 1.2$$

9. A static mixing device according to claim 8, wherein:

$$0.6 \leqq W_2/W_1 \leqq 1.1$$

10. A static mixing device adapted to be inserted in a fluid stream having a main flow direction with respect to a closed conduit, comprising:

at least two tabs projecting from said at least one bounding surface and inclined in the flow direction at preselected elevation angle between 10° and 45° to the interior surface of said conduit, said tabs being spaced apart in a direction transverse to said flow direction, the length (L) and width (W) of said tabs being selected so as to generate pairs of oppositely rotating the predominantly streamwise vortices at the tips of each tab, and downstream hairpin vortices interconnecting adjacent streamwise vortices generated by a single.

11. Static mixing device according to claim 10, wherein said elevation angle is between 20° and 35°.

12. A static mixing device according to claim 10, wherein:

$$0.5 \leqq L/W \leqq 3$$

13. A static mixing device according to claim 10, wherein:

$$1 \leqq L/W \leqq 2$$

14. A static mixing device according to claim 10, wherein said tabs are spaced apart a distance $W_s$ and wherein:

$$0.5 \leqq Ws/W \leqq 2$$

15. A static mixing device according to claim 12, wherein said tabs are in the shape of a trapezoid with the width of each said tab at the end in contact with said interior surface being $W_1$ and the width of said tab at the other end being $W_2$, and wherein:

$$0.3 \leqq W_2/W_1 \leqq 1.2$$

16. A static mixing device according to claim 15, wherein:

$$0.6 \leqq W_2/W_1 1.1$$

17. A static mixing device according to claim 10, wherein four equally spaced tabs are arranged in an array around the interior surface of said conduit.

18. A static mixing device according to claim 10, including at least two spaced apart arrays of said tabs.

19. A static mixing device according to claim 18, wherein the corresponding tabs of adjacent arrays are radially aligned.

* * * * *